United States Patent [19]

Schmalz

[11] 4,315,459

[45] Feb. 16, 1982

[54] METHOD FOR PROCESSING METAL MATERIAL INTO BALES

[75] Inventor: Roman Schmalz, Milwaukee, Wis.

[73] Assignee: Logemann Brothers Company, Milwaukee, Wis.

[21] Appl. No.: 250,881

[22] Filed: Apr. 3, 1981

Related U.S. Application Data

[60] Continuation of Ser. No. 126,423, Mar. 3, 1980, abandoned, which is a division of Ser. No. 22,805, Mar. 22, 1979, Pat. No. 4,230,037.

[51] Int. Cl.[3] ..... B30B 1/32

[52] U.S. Cl. ..... 100/39; 100/42

[58] Field of Search ..... 150/39, 42, 94, 95, 150/96, 97, 98 R, 232, 233, 246, 251, 218, 249, 250, 45, 50

[56] References Cited

U.S. PATENT DOCUMENTS

| | | | |
|---|---|---|---|
| 1,707,314 | 4/1929 | Towler | 100/251 X |
| 2,705,916 | 4/1955 | Millgard | 100/251 |
| 2,995,999 | 8/1961 | Holt | 100/233 X |
| 3,005,403 | 10/1961 | Van Endert | 100/98 R |
| 3,129,656 | 4/1964 | Judd | 100/98 R |
| 3,141,401 | 7/1964 | Lindemann | 100/98 R |
| 3,283,697 | 11/1966 | Findlay | 100/95 |
| 3,537,136 | 11/1970 | Solc | 100/251 X |
| 4,018,169 | 4/1977 | Schmalz | 100/39 |
| 4,094,240 | 6/1978 | Suzuki | 100/233 X |
| 4,149,457 | 4/1979 | Smith | 100/98 R |

FOREIGN PATENT DOCUMENTS

| | | | |
|---|---|---|---|
| 791164 | 12/1935 | France | 100/98 R |
| 1003139 | 9/1965 | United Kingdom | 100/98 R |

*Primary Examiner*—Billy J. Wilhite

*Attorney, Agent, or Firm*—Michael, Best & Friedrich

[57] ABSTRACT

A baling machine comprises a frame defining a first baling chamber having an open top and an opening formed in one end and a second baling chamber which communicates with the first baling chamber through the opening. A cover member is pivotally mounted on the frame and movable between an open position permitting access into the first baling chamber through the open top and a closed position covering the open top. A feed hopper is mounted on the frame for introducing material to be baled into the first baling chamber. A first compression ram is mounted adjacent to the first baling chamber and is movable into the first baling chamber for compressing the material in the first baling chamber and for thereby forming the material into a block having one end section which is aligned with the opening. A feed ram is mounted adjacent to the first baling chamber and is movable into the first baling chamber for moving the block end section into the second baling chamber through the opening. A shearing apparatus is mounted adjacent to the opening for severing the block end section from the body of the block which is located by the feed ram in the second baling chamber. A second compression ram is mounted adjacent to the second baling chamber and is movable into the second baling chamber for compressing the severed block end section and for thereby forming the severed block end into a complete bale.

4 Claims, 11 Drawing Figures

METHOD FOR PROCESSING METAL MATERIAL INTO BALES

This is a continuation of application Ser. No. 126,423 filed Mar. 3, 1980 now abandoned, which is a division of Ser. No. 022,805 filed Mar. 22, 1979 now U.S. Pat. No. 4,230,037.

BACKGROUND OF THE INVENTION

1. Field of the Invention

This invention relates to a method and apparatus for processing metal material into bales.

2. Description of the Prior Art

Attention is directed to U.S. Pat. No. 4,018,169, issued Apr. 19, 1977 to Roman Schmalz.

The method of the present invention is designed to form metal material into relatively compact bales in assembly line fashion.

SUMMARY OF THE INVENTION

A baling machine comprising a frame defining a first baling chamber having an open top and an opening formed in one end, and a second baling chamber which communicates with the first baling chamber through the opening. A cover member is pivotally mounted on the frame and is movable between an open position permitting access into the first baling chamber through the open top and a closed position covering the open top. Feed hopper means is mounted on the frame for introducing material to be baled into the first baling chamber through the open top. First compression ram means is mounted adjacent to the first baling chamber and is movable into the first baling chamber underneath the closed cover member for compressing the material in the first baling chamber into the shape of an elongated block having one end section which is aligned with the opening. Feed ram means is mounted adjacent to the first baling chamber and is movable into the first baling chamber underneath the closed cover member for moving the block end section through the opening into the second baling chamber. Shearing means is mounted adjacent to the opening for severing the block end section which is located in the second baling chamber from the body of the block. Second compression ram means is mounted adjacent to the second baling chamber and is movable into the second baling chamber for again compressing the severed block end section into the form of a completed bale. Bale ejection means is mounted adjacent to the second baling chamber for discharging the completed bale from the second baling chamber.

The apparatus as above described is operable to produce bales in assembly line fashion by following the steps of first introducing the material to be baled into the first baling chamber by means of the feed hopper means, then compressing the material in the first baling chamber by means of the first compression ram means into a block, and then feeding an end section of the block into the second baling chamber by means of the feed ram means. Next, the block end section is severed from the body of the block by means of the shearing means, and the severed end section is thereafter compressed in the second baling chamber by means of the second compression ram means into a completed bale. Continued operation of the second compression ram means will cause ejection of the completed bale from the second baling chamber.

DESCRIPTION OF THE PREFERRED EMBODIMENT

Figure 1:
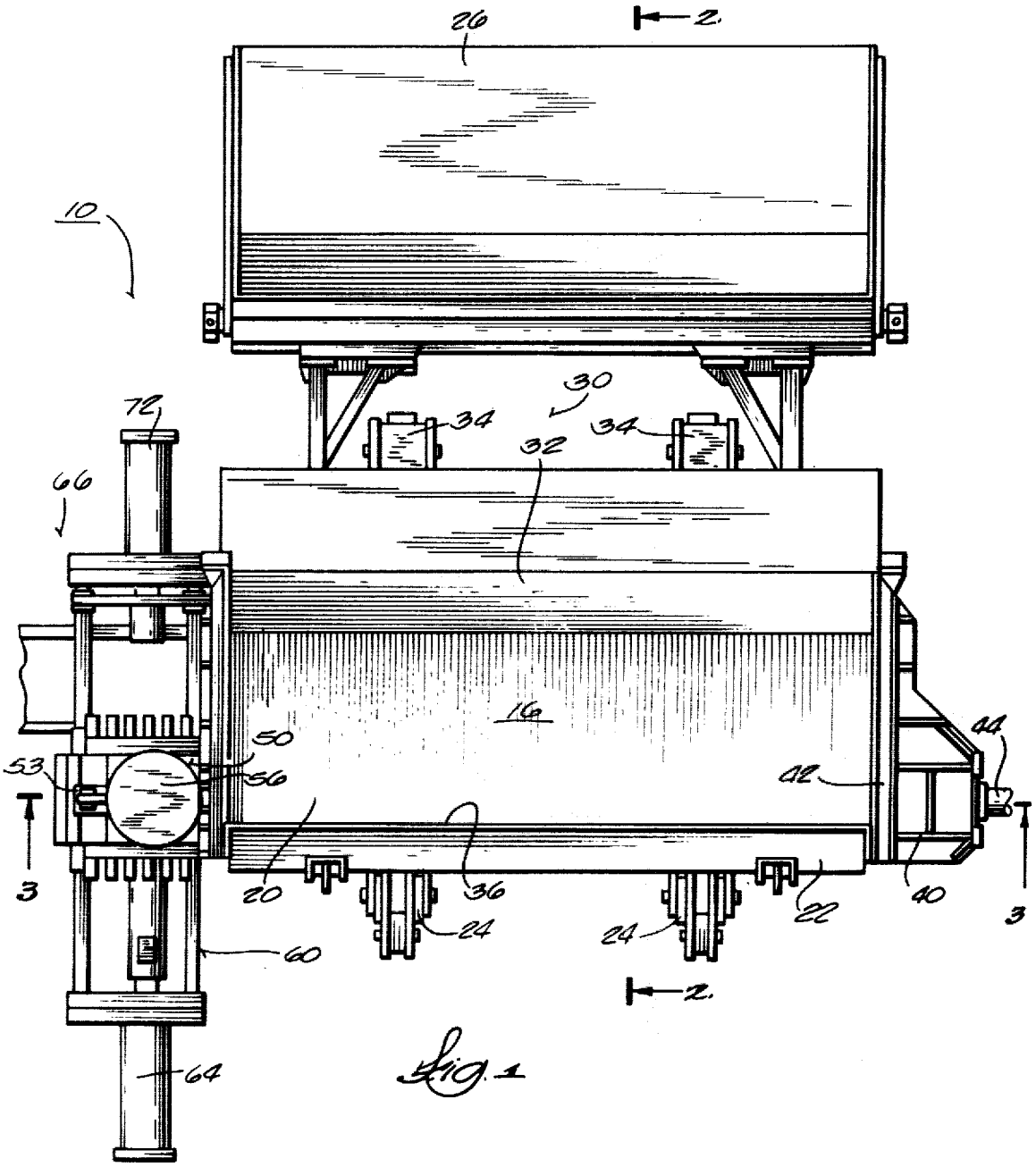
FIG. 1 is a top view of a baling machine which is capable of producing relatively compact bales in assembly line fashion.
Figure 3:
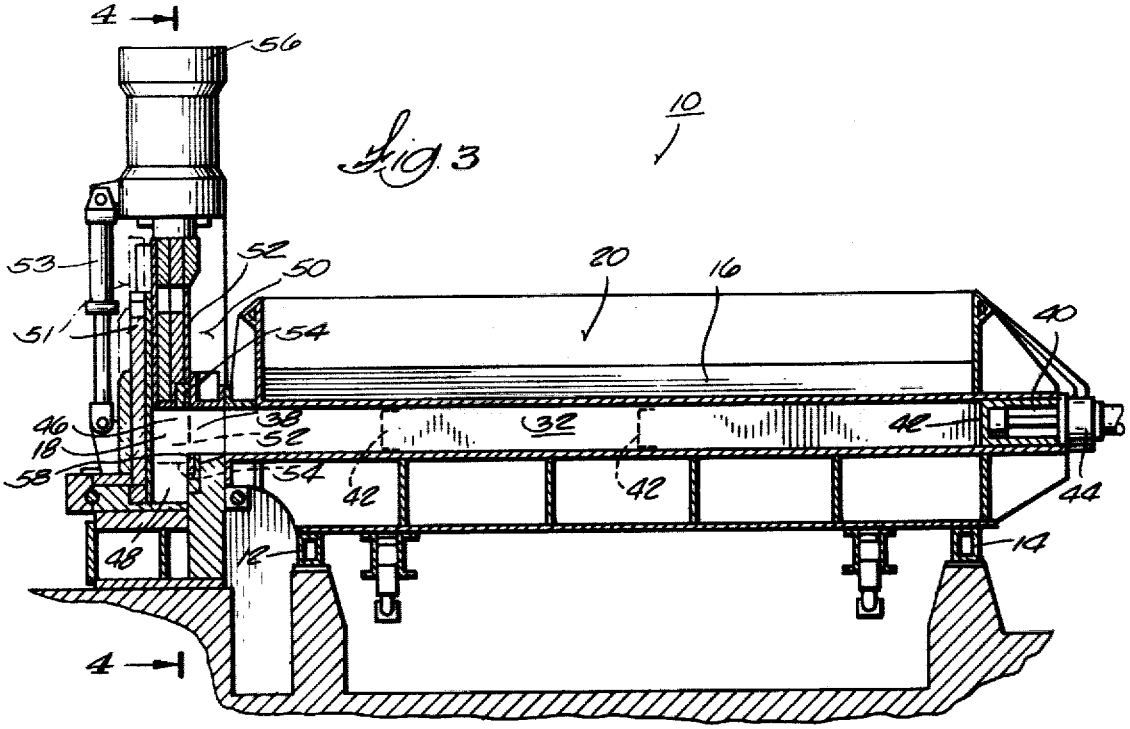
FIG. 3 is a sectional front elevational view of the baling machine taken along line 3—3 of FIG. 1.
Figure 2:
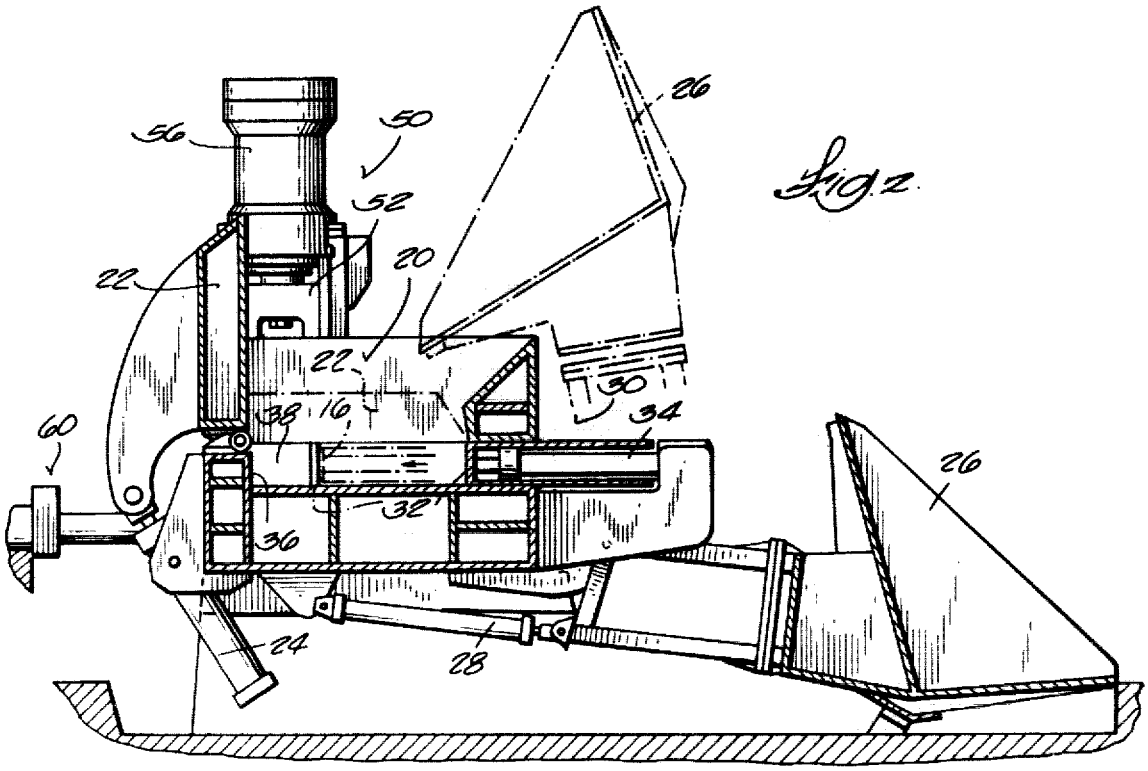
FIG. 2 is a sectional side view of the baling machine taken along line 2—2 of FIG. 1.

Referring first to FIGS. 1 through 3, an apparatus for processing metal material into bales is shown which includes a fabricated steel frame 10 mounted on the ground on suitable support members 12 and 14. As is best shown in FIG. 3, the frame generally forms two interconnected bailing chambers 16 and 18.

The first baling chamber 16 has an open top 20 (see FIG. 2). A cover member 22 is pivotally mounted on the frame 10 for movement between an open position (shown in solid lines in FIG. 2) in which access is permitted into the first baling chamber 16 through the open top 20 and a closed position (shown in phantom lines in FIG. 2) in which the cover member 22 covers the open top 20 and seals the first baling chamber 16. The cover member 22 is moved between the open and closed positions by a pair of double acting hydraulic power cylinders 24 (see also FIG. 1).

A feed hopper 26 is pivotally mounted on the frame 10 adjacent to one side of the first baling chamber 16 (see FIG. 2) and is movable between a substantially horizontal position adjacent to the ground (as shown in solid lines in FIG. 2), in which the feed hopper 26 acts as a ground-level loading platform into which the material desired to be baled can be placed, and an upraised position off the ground (as shown in phantom lines in FIG. 2), in which the feed hopper 26 is in a generally tilted position, and material located therein will naturally slide into the first baling chamber 16. The feed hopper 26 is moved between its horizontal position and its upraised position by a pair of double acting hydraulic power cylinders 28, only one of which is shown in FIG. 2.

First compression ram means 30 is mounted adjacent to the first baling chamber 16. As best shown in FIGS. 1 and 2, the first compression ram means 30 includes a baling head 32 which extends substantially along the entire longitudinal length of the first baling chamber 16 (see also FIGS. 6 and 7). The baling head 32 is movable into the first baling chamber 16 underneath the closed cover member 22 by a pair of double acting hydraulic power cylinders 34. Material which is located in the first baling chamber 16 is thereby compressed between the baling head 32 and the opposite longitudinal sidewall 36 of the first baling chamber 16.

An opening 38 (see FIGS. 2 and 3) is formed in a side corner of the first baling chamber 16 along the path of movement of the baling head 32. As can be seen in phantom lines in FIG. 2, when the baling head 32 reaches the end of its compression stroke, the leading edge of the baling head 32 is generally aligned with the interior side edge of the opening 38.

A feed ram 40 (see FIG. 3), is mounted adjacent to a corner of the first baling chamber 16 longitudinally across from the corner in which the opening 38 is formed. As best shown in FIG. 3, the feed ram 40 includes a power head 42 which is driven by a double acting power cylinder 44 for movement across the entire longitudinal length of the first baling chamber 16 toward the opening 38 and at right angles to the path of movement of the baling head 32.

The second baling chamber 18 communicates with the first baling chamber 16 through the above-described opening 38. As is best shown in FIG. 3, the second baling chamber 18 includes an upper chamber portion 46 which extends generally horizontally beyond the opening 38 and a lower chamber portion 48 which extends vertically below the upper chamber portion 46.

Figure 4:
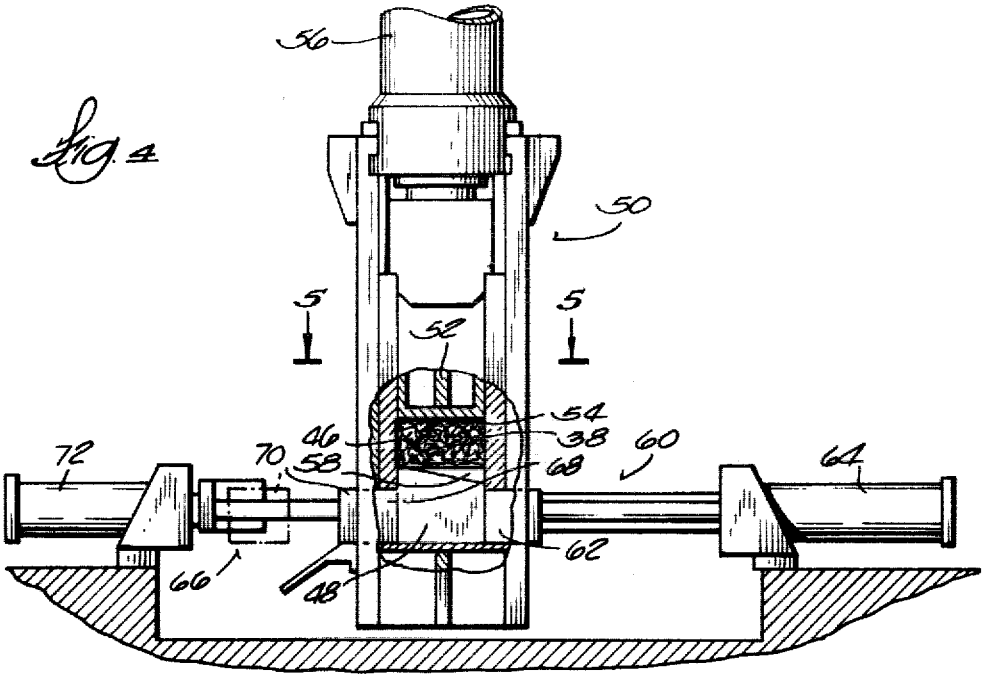
FIG. 4 is a side view, partially broken away, taken along line 4—4 of FIG. 3.

Shearing means 50 is mounted adjacent to the upper chamber portion 46. As is best shown in FIGS. 3 and 4, the shearing means 50 includes a shear head 52 having a lower cutting edge 54. The shear head 52 is movable like a guillotine between an upwardly raised position in which the cutting edge 54 extends above the upper edge of the opening 38 (as shown in solid lines in FIGS. 2, 3, and 4) and a downward, or fallen, position in which the cutting edge 54 extends below the lower edge of the opening 38 (as shown in phantom lines in FIG. 3). When the cutting edge 54 of the shear head 52 is located in its downward position, the shear head 52 substantially occupies the upper chamber portion 46 and blocks the opening 38 between the first baling chamber 16 and the second baling chamber 18 (see FIG. 3). When in this position, the shear head 52 also effectively seals the lower chamber portion 48 of the second baling chamber 18 from the upper chamber portion 46 thereof in much the same manner as the closed cover member 22 seals the first baling chamber 16. The shear head 52 is actuated between its upwardly raised and downward positions by a double acting power cylinder 56.

As best shown in FIGS. 3 and 4, the lower peripheral edge of the opening 38 is provided with a shear knife 58 which in the illustrated embodiment (see FIG. 4), is inclined at approximately 10° from the horizontal. The shear knife 58 is positioned so that, when the shear head 52 falls from its upwardly raised position to its downward position, the cutting edges 54 and 58 cooperate to shear material which is located in the path of the falling shear head 52. Furthermore, the severed portion will be simultaneously located by the underbody of the shear head 52 in the lower chamber portion 48 of the second baling chamber 18.

A gate member 51 (see FIG. 3) is mounted adjacent to the upper and lower chamber portions 46 and 48 oppositely spaced from the opening 38 and thereby located in the path of movement of the feed head 42. The gate member 51 is movable by means of a double acting hydraulic cylinder 53 between a closed position (shown in solid lines in FIG. 3), in which the gate member 51 defines a sidewall of the second baling chamber 18 and serves to contain and guide the movement of the shear head 52 as heretofore described; and an open position (shown in phantom lines in FIG. 3), which permits access into the second baling chamber 18 for maintenance and the like. Also, when the gate member 51 is located in its closed position, the interior surface of the gate member 51 serves as a "backstop" against which material fed through the opening 38 will abut and be thereby located in the path of movement of the shear head 52.

Second compression ram means 60 is mounted adjacent to the second baling chamber 18. As is best shown in FIG. 4, the second compression ram means 60 includes a baling head 62 which is movable into the lower chamber portion 48 of the second baling chamber 18 underneath the fallen shear head 52 by a double acting hydraulic cylinder 64. The path of movement of the baling head 62 in the second baling chamber 18 is in a direction which is diametrically opposite to the direction of movement of the baling head 32 in the first baling chamber 16.

Figure 5:
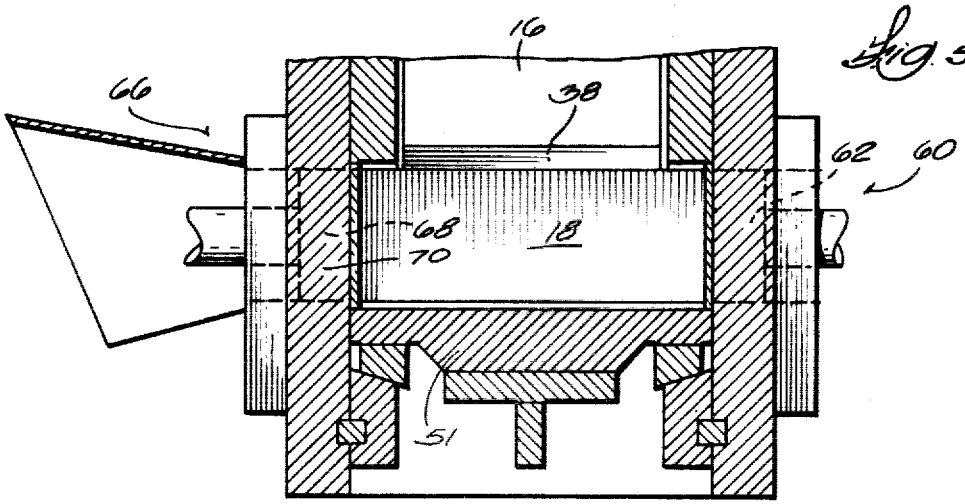
FIG. 5 is an exploded sectional view of the baling machine taken generally along lines 5—5 of FIG. 4.

Bale ejection means 66 (see FIGS. 1, 4 and 5) is mounted adjacent to the lower chamber portion 48 of the second baling chamber 18. As best shown in FIG. 4, the lower chamber portion 48 includes a discharge opening 68 which is oppositely spaced from the baling head 62 and which consequently lies in the path of movement of the baling head 62 across the lower chamber portion 48. A gate member 70 is operatively movable relative to the discharge opening 68 between a first position in which the discharge opening 68 is closed (as shown in solid lines in FIGS. 4 and 5) and a second position in which the discharge opening 68 is open (as shown in phantom lines in FIG. 4). The gate member 70 is operatively connected to a hydraulic cylinder 72 which includes a pressure sensitive valve assembly (not shown) such that the gate member 70 is normally biased toward its first, or closed, position by action of the hydraulic cylinder 72, but when a given magnitude of pressure is exerted against the gate member 70, the pressure sensitive valve will release the hydraulic cylinder 72 and allow the gate member 70 to be displaced out of its first, or closed, position to its second, or open, position in response to the movement of the baling head 62.

OPERATION

Figure 6:
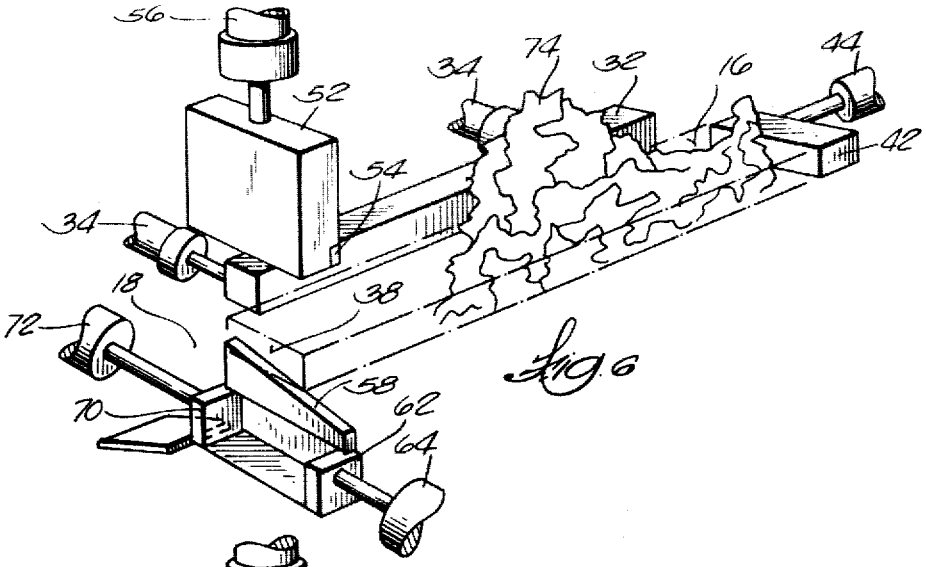
FIGS. 6, 7, 8, 9, 10 and 11 are a series of partially schematic perspective side views (with parts broken away) showing the sequence of operation of the baling machine.

Referring now principally to FIGS. 6 through 11, the above described baling apparatus begins its operative cycle with its components positioned substantially as shown in solid lines in FIGS. 2 and 6. More particularly, the cover member 22 is in its open position; the first baling head 32, the second baling head 62 and the power head 42 are all in their retracted positions; the shear head 52 is located in its upwardly raised position; the gate member 70 is in its first, or closed, position; the feed hopper 26 is in its substantially horizontal position.

With the above components thus disposed, the first operational step is to introduce material 74 to be baled into the first baling chamber 16. During this step, the material 74 is first loaded into the feed hopper 26 and the power cylinders 28 thereafter actuated to lift the feed hopper 26 to its upwardly raised position. As before described the material 74 located in the feed hopper 26 slides into the first baling chamber 16 (as shown in FIG. 6).

Figure 7:
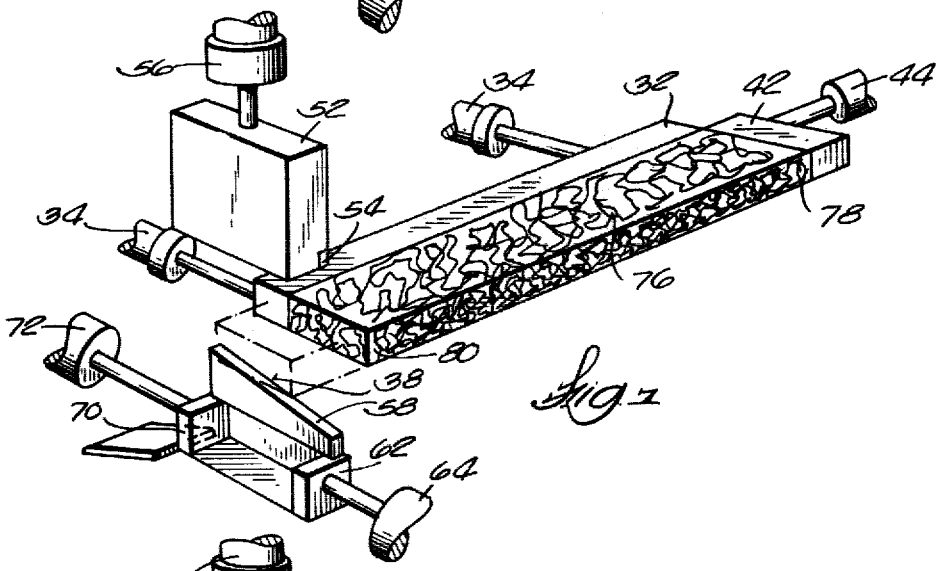

The next step is to compress the material 74 which is located in the first baling chamber 16. In this step, the power cylinders 24 are first actuated to close the cover member 22 and thus seal the first baling chamber 16, and the power cylinders 34 are thereafter energized to move the first baling head 32 across the first baling chamber 16 underneath the closed cover member 22. As is shown in FIG. 7, at the time that the baling head 32 reaches the end of its compression stroke, the material 74 located in the first baling chamber 16 will be formed into the shape of an elongated block 76 having longitudinally spaced end sections 78 and 80. These longitudinally spaced end sections will be generally perpendicularly aligned with the opening 38 between the first baling chamber 16 and the second baling chamber 18.

Figure 8:
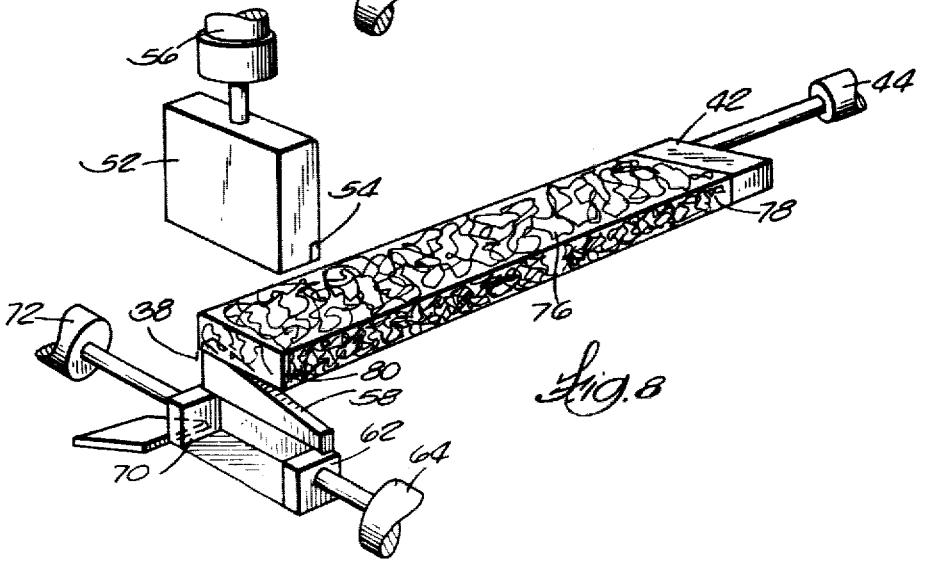

The next step is shown in FIG. 8, in which the block end section 80 closest to the opening 38 is fed through the opening 38 into the upper chamber portion 46 of the second baling chamber 18. In this step, the power cylinder 44 is energized and the feed head 42 pushes against the adjacent block end section 78 thereby moving the entire block 76 in the first baling chamber 16 until the opposite block end section 80 moves into and occupies the upper chamber portion 46 of the second baling chamber 18. The stroke of the feed head 42 can be adjusted, such as by a timing mechanism (not shown), to control the protruding length of the end section 80 in the second baling chamber 18, up to the maximum protruding length in which the block end section 80 abuts against the interior surface of the closed gate member 51.

Figure 9:
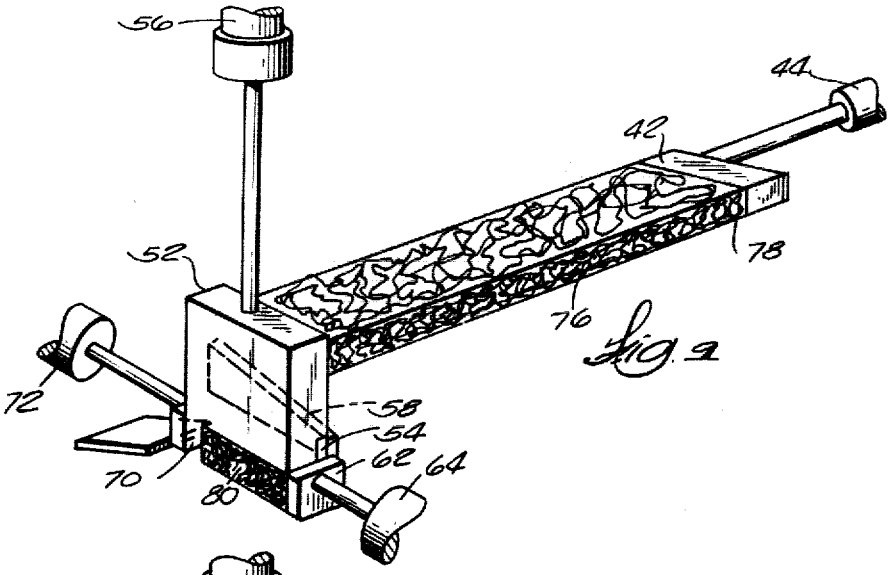
Figure 10:
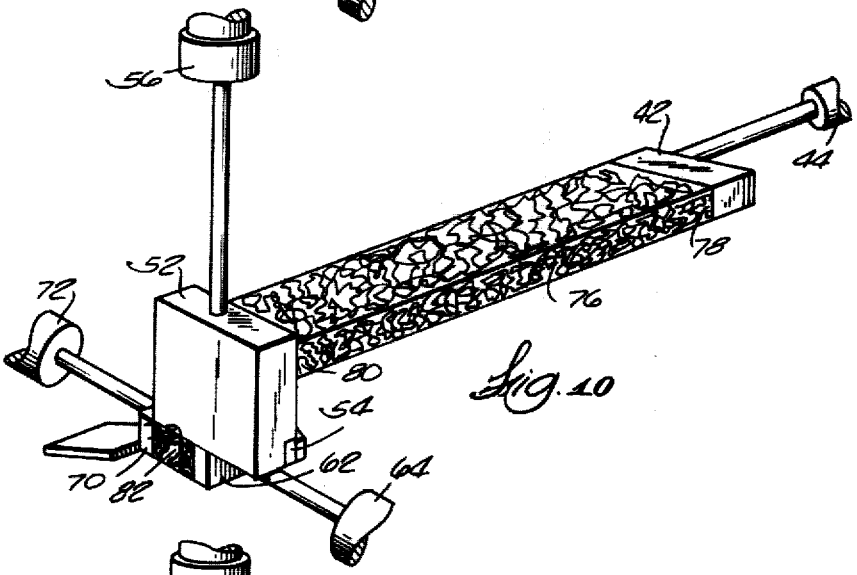
Figure 11:
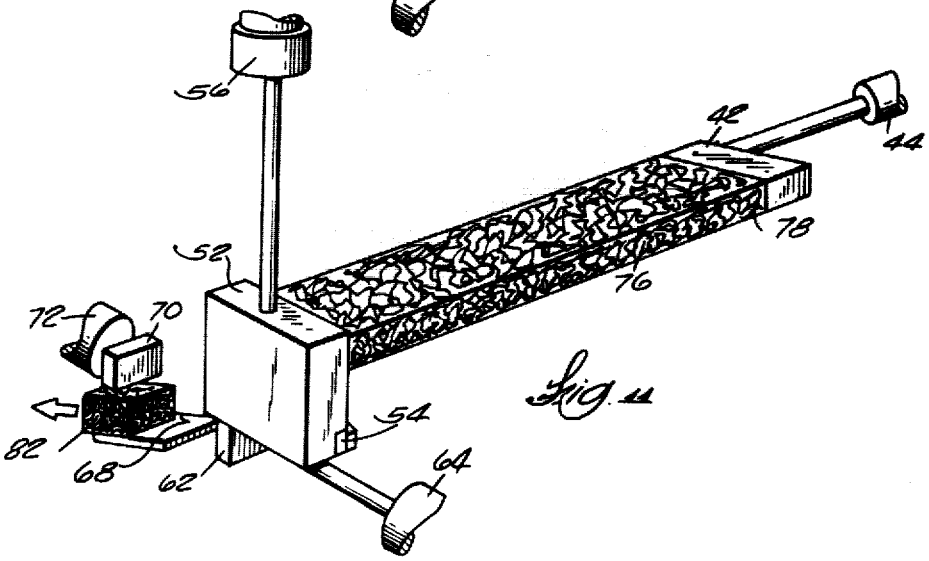

The next step is shown in FIG. 9, in which the end section 80 occupying the upper chamber portion 46 of the second baling chamber 18 is severed from the body of the block 76. In this step, the power cylinder 56 is actuated and the shear head 52 is driven from its upwardly raised position toward its downward position. A portion of the end section 80 is thereby caught between the cutting edges 54 and 58, and severed from the block 76. The end section 80 will also be driven by the downwardly moving shear head 52 into the lower chamber portion 48 of the second baling chamber 18. At this point, the shear head 52 also substantially occupies the upper chamber portion 46 blocking the opening 38 and sealing off the lower chamber portion 48.

The next step (shown in FIG. 10) is to again compress the severed end section 80 in the lower chamber portion of the second baling chamber 18. The power cylinder 64 is actuated and the severed end 80 is compressed between the baling head 62 and the yieldably biased gate member 70. As the pressure exerted by the baling head 62 against the severed end 80, and thus against the gate member 70 itself, increases, the severed end section 80 is successively compressed from its initially severed size into a smaller bale size.

The next step (shown in FIG. 11) is to eject the completed bale 82 from the second baling chamber 18. In this step, the baling head 62 continues to progressively compress the severed end 80 against the yieldably biased gate member 70 and will eventually create a force which is sufficient to release the pressure sensitive valve located in the power cylinder 72. At this time, the power cylinder 72 releases, and the continued action of the baling head 62 against the bale 82 will move the gate member 70 from its closed to its open position. The bale 82 will be thus pushed from the lower chamber portion 48 of the second baling chamber 18 by the baling head 62. The power cylinder 64 can be thereafter actuated to return the baling head 62 back to its retracted position by suitable automatic or manual control means, and the power cylinder 72 likewise automatically or manually actuated to return the gate member 70 back to its normally closed position.

The apparatus can be recycled, following the sequenced steps as heretofore described. More particularly, the next steps are to first raise the shear head 52 by action of the power cylinder 56 back to its upwardly raised position, and then again activate the power cylinder 44 to move the feed head 42 against the block 76 and thus move a newly defined end section into the upper chamber portion 46 of the second baling chamber 18. As before explained, such actuation of the power cylinders 56 and 44 may be automatically sequenced or manually controlled. At the end of this step, the block 76 will occupy the same general position as is shown in FIG. 8.

The next step is to again drive the shear head 52 from its upwardly raised position to its downward position, thereby severing another end section off the block 76. This step is thereafter followed by the reactivation of the power cylinder 64 to move the baling head 62 into the lower chamber portion 48 of the second baling chamber 18 to form another completed bale 82. Movement of the gate member 70 from its closed position to its open position will shortly follow in response to continued operation of the power cylinder 64 and the resultant movement of the baling head 62, and a newly formed bale will be ejected from the lower chamber portion 48 of the second baling chamber 18.

As should be apparent, the above sequence of steps can be repeated either manually or automatically until the entire length of the block member 76 has been successively formed into completed bales. At this time, the feed head 42 can be moved to its retracted position, the cover member 22 moved to its open position, and the feed hopper 26 loaded and operated to introduce more material to be baled into the first baling chamber 16.

While the baling apparatus of the present invention can be of various sizes, in one commercial model thereof, when the baling head 32 is in its retracted position, the first baling chamber 16 has an overall maximum length of approximately 20 feet, an overall height of approximately 4 feet, and an overall width of approximately 6 feet. When the cover member 22 is closed and the baling head 32 is at the end of its compression stroke, the first baling chamber 16, and thus the block 76 itself, measures approximately 20 feet long, 1 foot high, and 2 feet wide. In this model, the lower chamber portion 48 of the second baling member 18 has a maximum length of 12 inches, a maximum height of 8 inches, and a maximum width of 24 inches. A unit of this approximate size will produce a completed bale measuring 12 inches by 8 inches by 15 inches and having a weight of approximately 200 pounds. Generally, this unit can produce approximately 4 completed bales per minute following the above described sequence of steps.

I claim:

1. A method of forming compact bales of material comprising the following steps:

(a) introducing the material to be baled into a first baling chamber, said baling chamber comprised of a bottom, four walls and an open top;

(b) positioning a cover member on the open top of the first baling chamber to seal the material therein;

(c) compressing the material in the first baling chamber into the shape of a block by applying pressure to said material in a horizontal direction from one side of the first baling chamber;

(d) feeding an end section of the block from the first baling chamber into an interconnected second baling chamber, said feeding movement being in a direction at right angles to the direction of the baling pressure applied to said material as recited in paragraph (c);

(e) severing the end section located in the second baling chamber from the body of the block; and (f) compressing the severed end section in the second baling chamber to thereby form a completed bale.

2. The method of claim 1 and further including the following step which is performed after step (f):

(g) ejecting the completed bale from the second baling chamber.

3. The method of claim 2 wherein step (d) includes locating a portion of the end section over a cutting edge which lies generally along the point where the first and second baling chambers interconnect; and wherein step (e) includes driving a shear ram head from a raised position above the end section in the second baling chamber downwardly upon the end section, the shear ram head having a cutting edge which cooperates with the first mentioned cutting edge in shearing the end section from the body of the block.

4. The method of claim 3 and further including the following steps which are performed after step (g):

(h) raising the cutting ram head from its downward cutting position back to its raised position;

(i) feeding a newly defined end section into the second baling chamber as in step (d);

(j) severing the newly defined end section as in step (e);

(k) compressing the newly defined end section as in step (f); and (l) ejecting the completed bale formed of the newly defined end section as in step (g).

* * * * *